US007426805B2

(12) United States Patent
Voegele, Jr. et al.

(10) Patent No.: US 7,426,805 B2
(45) Date of Patent: Sep. 23, 2008

(54) BUILDING BLOCK ASSEMBLY SYSTEM

(75) Inventors: William P. Voegele, Jr., Pittsburgh, PA (US); Raymond A. McNally, Blawnox, PA (US)

(73) Assignee: Extech/Exterior Technologies, Inc., Pittsburgh, PA (US)

( * ) Notice: Subject to any disclaimer, the term of this patent is extended or adjusted under 35 U.S.C. 154(b) by 0 days.

(21) Appl. No.: 11/676,392

(22) Filed: Feb. 19, 2007

(65) Prior Publication Data

US 2007/0193152 A1 Aug. 23, 2007

Related U.S. Application Data

(60) Provisional application No. 60/775,164, filed on Feb. 21, 2006.

(51) Int. Cl.
*E04B 5/46* (2006.01)
*E04C 1/42* (2006.01)

(52) U.S. Cl. ..... 52/308; 52/306; 52/656.1; 52/656.5; 52/656.6

(58) Field of Classification Search ..... 52/306–308, 52/656.1, 656.5–656.7, 786.1
See application file for complete search history.

(56) References Cited

U.S. PATENT DOCUMENTS

| | | | | | |
|---|---|---|---|---|---|
| 2,052,229 | A | | 8/1936 | Hyde | |
| 3,234,699 | A | | 2/1966 | Smith | |
| 3,844,087 | A | | 10/1974 | Schultz et al. | |
| 3,889,434 | A | * | 6/1975 | Shelver | 52/172 |
| 4,058,943 | A | * | 11/1977 | Sturgill | 52/223.7 |
| 4,114,337 | A | | 9/1978 | Neuhardt | |
| 4,251,964 | A | | 2/1981 | Francis | |
| 4,455,798 | A | | 6/1984 | Tsakiris | |
| 4,610,901 | A | | 9/1986 | Linscott | |
| 4,638,613 | A | | 1/1987 | Tonsmann | |
| 4,774,793 | A | * | 10/1988 | Mayer | 52/308 |
| 4,959,937 | A | * | 10/1990 | Mayer | 52/308 |
| 4,965,975 | A | | 10/1990 | Schwarz | |
| 4,986,048 | A | * | 1/1991 | McMarlin | 52/306 |
| 4,999,964 | A | * | 3/1991 | Taylor | 52/477 |
| 5,003,744 | A | * | 4/1991 | Taylor | 52/308 |
| 5,010,704 | A | * | 4/1991 | Thompson | 52/308 |
| 5,031,372 | A | * | 7/1991 | McCluer | 52/307 |
| 5,042,210 | A | * | 8/1991 | Taylor | 52/307 |
| D331,469 | S | | 12/1992 | McMarlin | |
| 5,218,806 | A | * | 6/1993 | Taylor | 52/410 |
| 5,259,161 | A | * | 11/1993 | Carter | 52/307 |
| 5,356,675 | A | | 10/1994 | Unger et al. | |
| 5,430,985 | A | * | 7/1995 | Coleman | 52/308 |

(Continued)

*Primary Examiner*—Richard E. Chilcot, Jr.
*Assistant Examiner*—Andrew J Triggs
(74) *Attorney, Agent, or Firm*—McKay & Associates, P.C.

(57) ABSTRACT

A block assembly including a plurality of first framing members each having a first longitudinal axis and a plurality of second framing members each having a second longitudinal axis, wherein the first longitudinal axis is substantially perpendicular to the second longitudinal axis such that the first and second framing members together form a grid including a plurality of openings. The assembly further includes a plurality of blocks, such as glass, plastic or masonry blocks, each being received within a respective one of the openings, and a plurality of support rods, each of the support rods being inserted through a respective one or more of the first framing members along the first longitudinal axis of each of the one or more of the first framing members and being inserted through each of the second framing members.

11 Claims, 4 Drawing Sheets

U.S. PATENT DOCUMENTS 5,448,864 A * 9/1995 Rosamond ..... 52/307
5,485,702 A 1/1996 Sholton
5,640,818 A * 6/1997 Wirkus et al. ..... 52/306
5,640,819 A * 6/1997 Wirkus et al. ..... 52/308
5,704,177 A 1/1998 Wirkus et al.
5,715,636 A 2/1998 Taylor
5,740,646 A * 4/1998 Wirkus et al. ..... 52/308
5,806,263 A * 9/1998 Coleman ..... 52/306
5,845,443 A * 12/1998 Wirkus et al. ..... 52/308
5,904,018 A * 5/1999 Campagnari ..... 52/306
6,922,961 B2 8/2005 Wright
7,243,468 B2 * 7/2007 Wright ..... 52/306
7,373,763 B2 * 5/2008 Voegele et al. ..... 52/308
2001/0002525 A1 * 6/2001 Wirkus ..... 52/306
2004/0177577 A1 * 9/2004 Voegele et al. ..... 52/306
2007/0193152 A1 * 8/2007 Voegele et al. ..... 52/306

* cited by examiner

BUILDING BLOCK ASSEMBLY SYSTEM

CROSS-REFERENCE TO RELATED APPLICATION

This application claims the benefit of provisional application Ser. No. 60/775,164, entitled "Panelized Glass Block Mounting System," which was filed on Feb. 21, 2006, the disclosure of which is incorporated herein by reference.

FIELD OF THE INVENTION

The present invention relates to grid systems for building walls or other structures utilizing building blocks, most commonly glass blocks.

BACKGROUND OF THE INVENTION

Grid systems designed to hold building blocks in a spaced relationship are well known. Most commonly, these systems are intended as an alternative to laying the blocks (typically glass, plastic or masonry) in mortar. The existing grid systems tend to use framing member components of thin dimensions and of relatively weak construction. Furthermore, existing grid systems have relatively weak connections between the horizontal and vertical framing members and, in some cases, no connections at all, and do not include the capability to accept strengthening elements, such as steel rods, inserted within the framing members to provide added strength. In addition, existing grid systems typically rely on the block elements themselves to act as gauges to determine the spacing between the vertical or horizontal framing members. This can result in a grid system which is not precisely aligned owing to variations in the sizes of the blocks or foreign objects that may be lodged between the blocks and the framing members. Moreover, should water pass through the outer portions of the joints, existing grid systems do not have a provision for directing the leakage water to the bottom of the wall and then exhausting the water to a desired location. Finally, existing grid systems are not built with the option for accepting rectilinear blocks which have flat, square edges and alternatively, common glass blocks which have recessed ridges around their perimeter edges. Thus, there is a need for a block mounting system that addresses one or more of the above-described problems associated with existing grid systems.

SUMMARY OF THE INVENTION

The present invention, in one or more embodiments, provides a unique grid system for holding building blocks firmly in place and sealing same against air and water infiltration and, further, providing directed water seepage, should water enter the system. Further, the invention, in one or more embodiments, provides a system of panelized building blocks that holds the blocks firmly in an aligned position and which, owing to internal tensioned steel rods or the like, offers great strength, including resistance to deflection caused by pressure from high winds.

The system can accommodate either common hollow glass blocks or blocks (of any material) of three-dimensional rectilinear form. The system, in a preferred embodiment, includes perimeter flanges which allow the panelized block arrays to be set into conventional curtainwall systems. The widths of the joints between the blocks are adjustable and can be made as small as ⅛ inch, a feature which most architects and builders find desirable.

In one embodiment, the invention relates to a block assembly including a plurality of first framing members each having a first longitudinal axis and a plurality of second framing members each having a second longitudinal axis, wherein the first longitudinal axis is substantially perpendicular to the second longitudinal axis such that the first and second framing members together form a grid including a plurality of openings. The assembly further includes a plurality of blocks, such as glass, plastic or masonry blocks, each being received within a respective one of the openings, and a plurality of support rods, each of the support rods being inserted through a respective one or more of the first framing members along the first longitudinal axis of each of the one or more of the first framing members and being inserted through each of the second framing members. Each of the first framing members may have two or more of the support rods inserted therethrough. In addition, each of the support rods may be inserted through a respective two or more of the first framing members.

Furthermore, the assembly may include one or more flanges provided along at least a portion of the perimeter of the block assembly. Such flanges are adapted to be received in a framing system, such as a curtainwall system, intended to receive flat glass.

Also, each of the support rods may have a first threaded end and a second threaded end, wherein a first nut is provided on each first threaded end and a second nut is provided on the second threaded end. In such a configuration, each first nut, each second nut and the support rods bind the first framing members, the second framing members and the blocks together. The block assembly may further include a first jamb member provided at a first outer side of the assembly, a second jamb member provided at a second outer side of the assembly opposite the first outer side, a sill member provided at a third outer side of the assembly, and a head member provided at a fourth outer side of the assembly opposite the third outer side. In that configuration, each of the support rods is inserted through the first jamb member and the second jamb member, and one or more of the first jamb member, the second jamb member, the sill member, and the head member may each include one or more flanges adapted to be received in a framing system intended to receive flat glass.

Preferably, each joint between adjacent blocks is between about one-eighth of an inch and about one-half of an inch wide, and is sealed with a sealant such as silicone. The assembly may also include a non-metallic material provided adjacent to the one or more flanges to resist thermal transfer from a weathering side of the one or more flanges to the interior of the block assembly. The non-metallic material may be urethane or another plastic material. Further, the sill member may include at least one hole which is positioned to allow water which has accumulated in a cavity provided in said sill member to seep (weep) out the bottom of the assembly.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DESCRIPTION OF THE PREFERRED EMBODIMENTS

Figure 1:
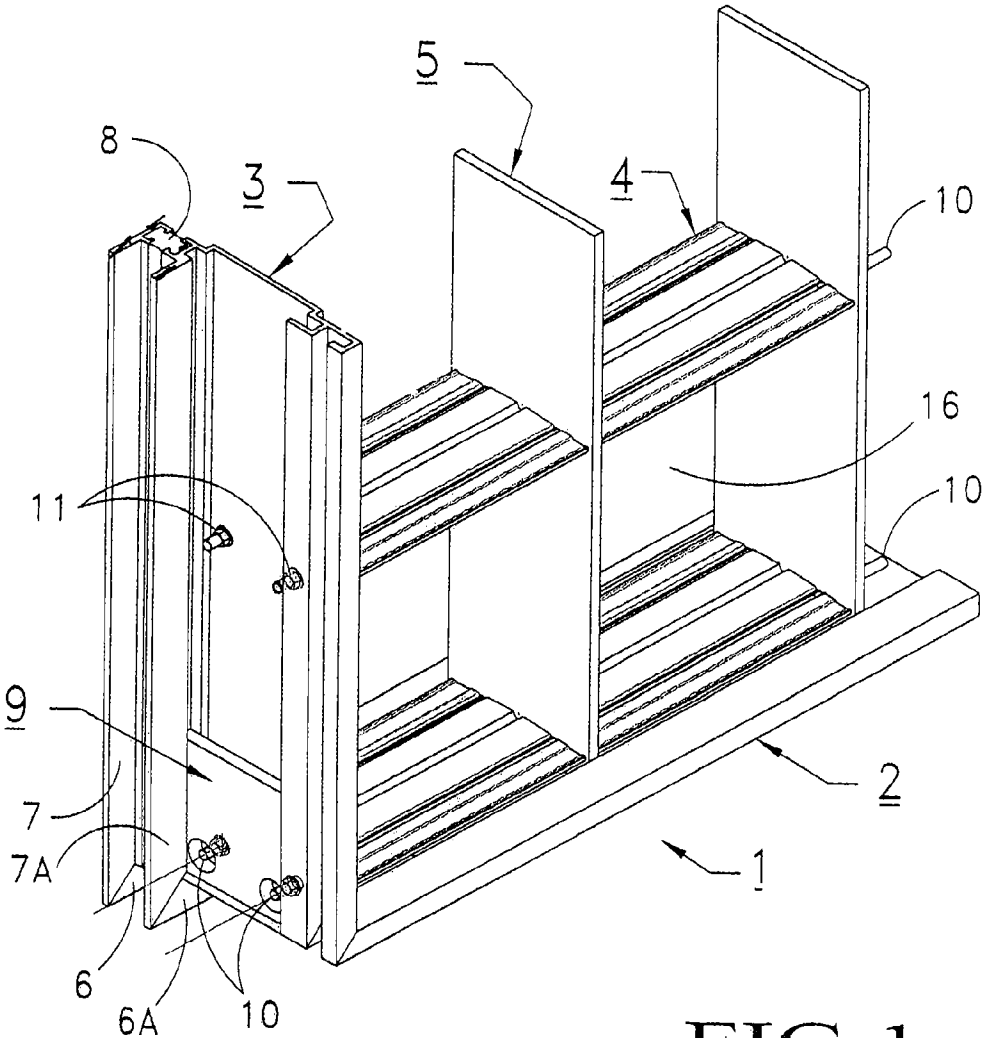
FIG. 1 is an isometric view of a corner portion of a block assembly according to one particular embodiment of the invention.

FIG. 1 is an isometric view of a corner portion of one embodiment of a block assembly according to the present invention showing a sill member 2, a jamb member 3, horizontal internal framing members 4 and vertical internal framing members 5. The sill and jamb members 2 and 3 are held together at the corners by a clip-angle 9 which slips into cavities in both sill member 2 and jamb member 3. In an assembly which is complete so as to fill a rectangular opening in a building or within curtainwall framing, there will be a head member (not shown) similar to sill member 2 and a jamb member 3 on the opposite side of the opening similar to the illustrated jamb member 3. Threaded rods 10, preferably approximately 3/16" diameter, pass through a first jamb member 3 (on one side of the assembly), through the horizontal internal framing members 4 and through punched holes in the vertical internal framing members 5. The threaded rods 10 pass through all of these components until they ultimately pass through the jamb member 3 at the opposite side of the assembly, at which point nuts 11 are threaded onto the rods 10 and tightened so as to draw the assembly together.

Figure 2:
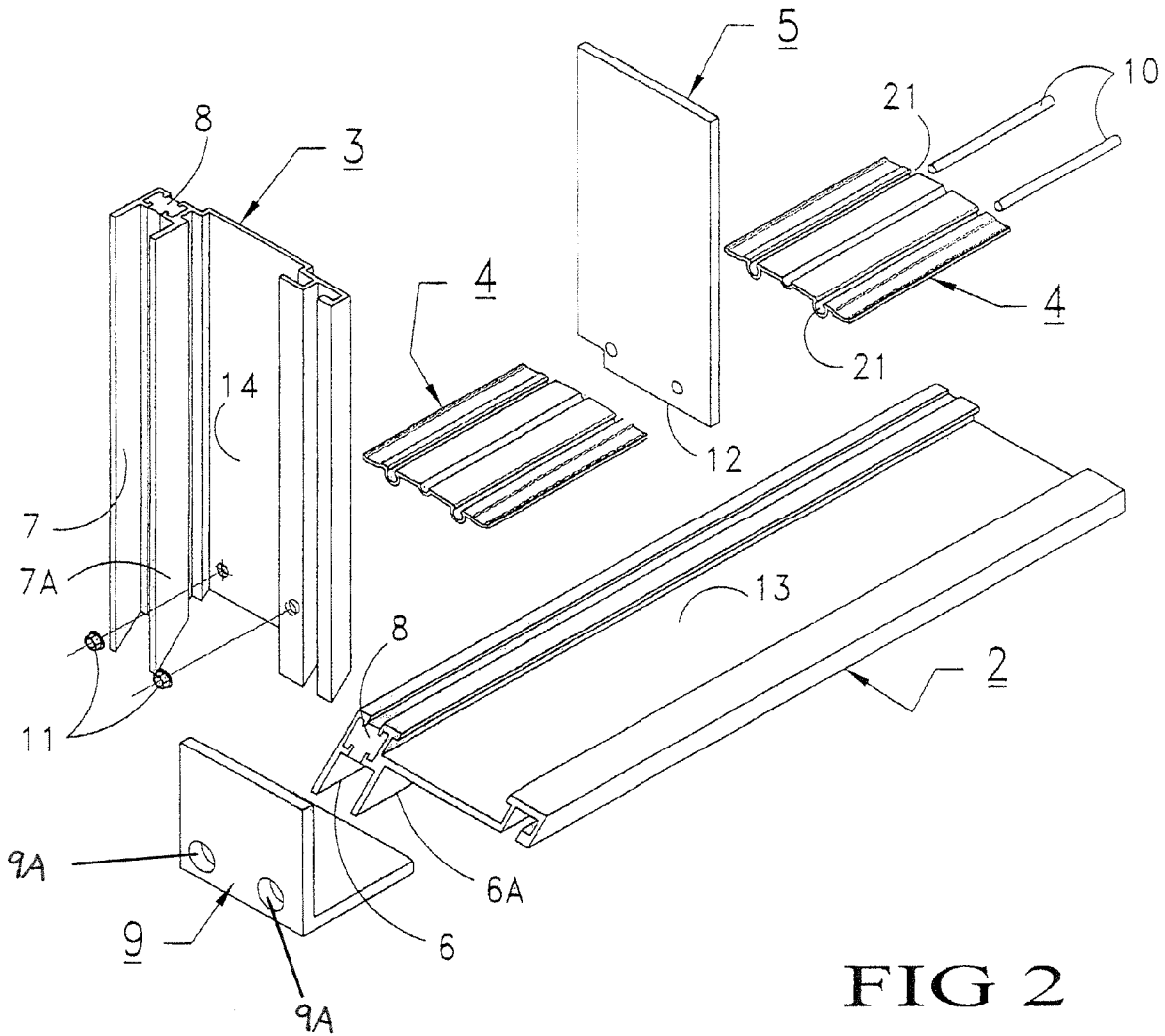
FIG. 2 is an exploded view of a portion of the assembly shown in FIG. 1.

FIG. 2 shows an exploded view of a portion of the assembly shown in FIG. 1 which illustrates the components and construction described above in more detail. As seen in FIG. 2, the horizontal internal framing members 4 are provided with rounded open channels 21 (preferably by an extrusion process) which allow the rods 10 to be passed through the channels 21 and then through holes in the vertical internal framing members 5 and ultimately through the jamb members 3 before nuts 11 are applied and tightened at each end of the assembly. FIG. 2 also illustrates clip-angle 9 which is able to slide into channel-shaped cavity 13 provided in the sill member 2 and also into channel-shaped cavity 14 provided in the jamb member 3. FIG. 2 also illustrates a preferred embodiment wherein flanges 7 and 7A protrude from jamb members 3 and flanges 6 and 6A protrude from sill and head members 2. Flanges 7 and 7A, and also flanges 6 and 6A, respectively, are designed to provide a perimeter band approximately 1 inch wide which may be fit into a curtainwall assembly (or whatever similar cavity filler size may be required to fit the flanges into a curtainwall assembly) or similar framing system which may be structured to normally receive flat glass. FIG. 2 also illustrates an optional thermal break 8 which is composed of a non-metallic material such as urethane and whose function is to minimize thermal transfer from flange 7 to 7A and from flange 6 to 6A and also transversely through sill and head members 2 and jamb members 3 (i.e., from a weathering side of the flanges to the interior of the block assembly).

FIG. 2 shows that the vertical internal framing member 5 is preferably notched at the bottom so as to leave a straight area 12 which is of a length sufficient to fit snugly into cavity 13 of sill member 2. The vertical internal framing member 5 is notched similarly at the top so that its remaining straight portion 12 similarly fits into cavity 13 of head member 2.

Figure 3:
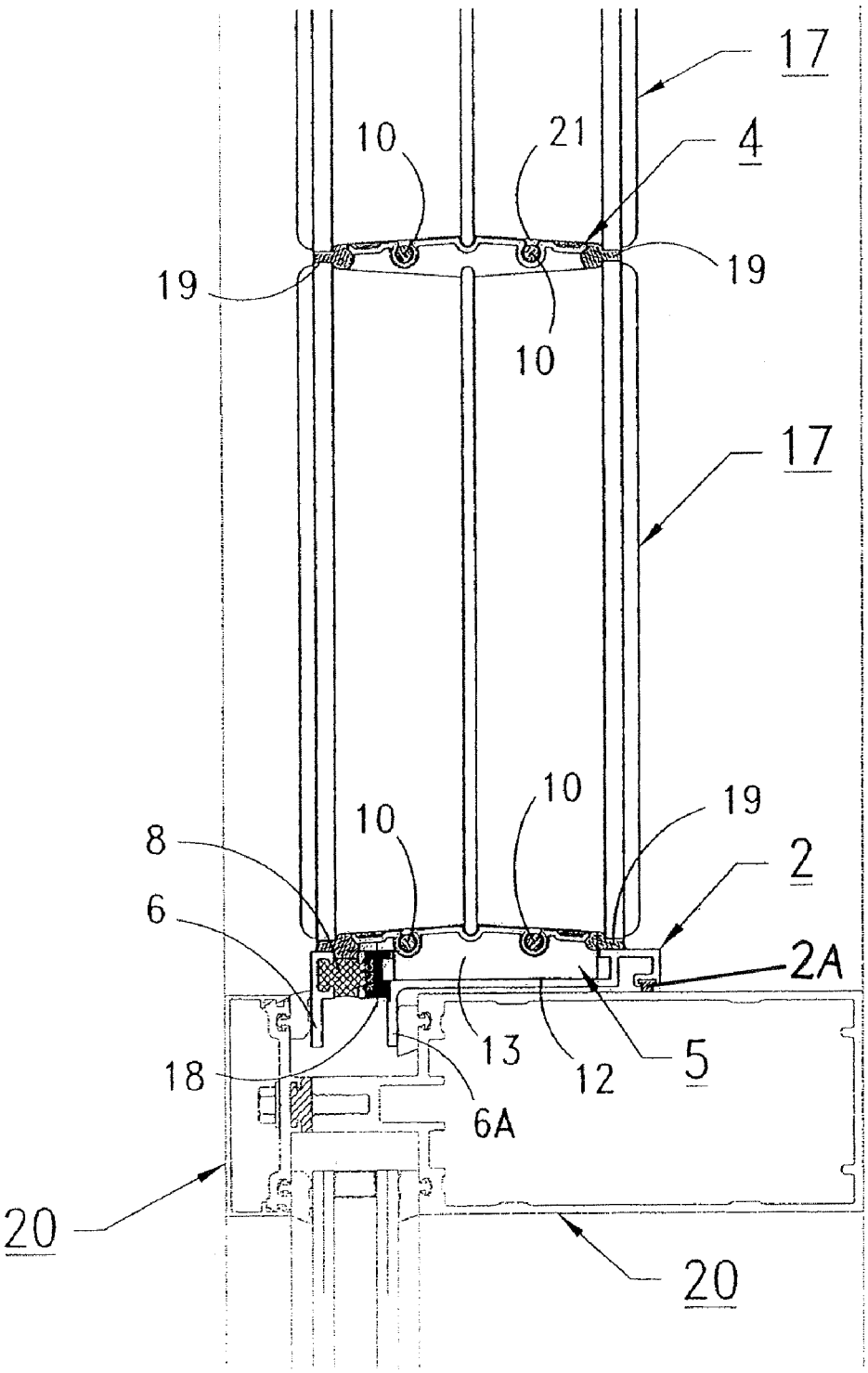
FIG. 3 is a sectional view of the sill member and one of the horizontal internal framing members of the assembly shown in FIG. 1.

FIG. 3 is a sectional view of the sill member 2 and one of the horizontal internal framing members 4 of the assembly. Preferably, the framing member 4 is an extrusion, typically of aluminum or PVC, which, as described above, includes the open rounded channels 21 into which the threaded rods 10 are inserted. As the grid of framing members 4 and 5 is being assembled, glass blocks 17 are inserted into the openings of the grid such that when the rods 10 are inserted and nuts 11 are threaded onto the ends and drawn tight, the entire assembly captures the glass blocks 17 within the grid system. The configuration of the horizontal internal framing members 4 is preferably designed to be similar to the edge configuration of the glass blocks 17 so that said glass blocks 17 are locked into the desired position. At the sill member 2, the threaded rods 10 are also the means for drawing the assembly together. The blocks 17 may be made of another material, such as plastic or masonry.

FIG. 3 also illustrates how the straight area 12 (the unnotched portion) of the vertical internal framing members 5 fits into the cavity 13 of the sill member 2. The cavity 13 is also turned upward as to catch and control water which may have leaked into the assembly from above. A hole 18 drilled in the sill member 2 is positioned to allow water which may have accumulated in the cavity 13 to seep out the bottom of the assembly. In FIG. 3, the assembly is shown in a preferred embodiment wherein the flanges 6 and 6A are captured within a conventional aluminum curtainwall system 20.

Figure 4:
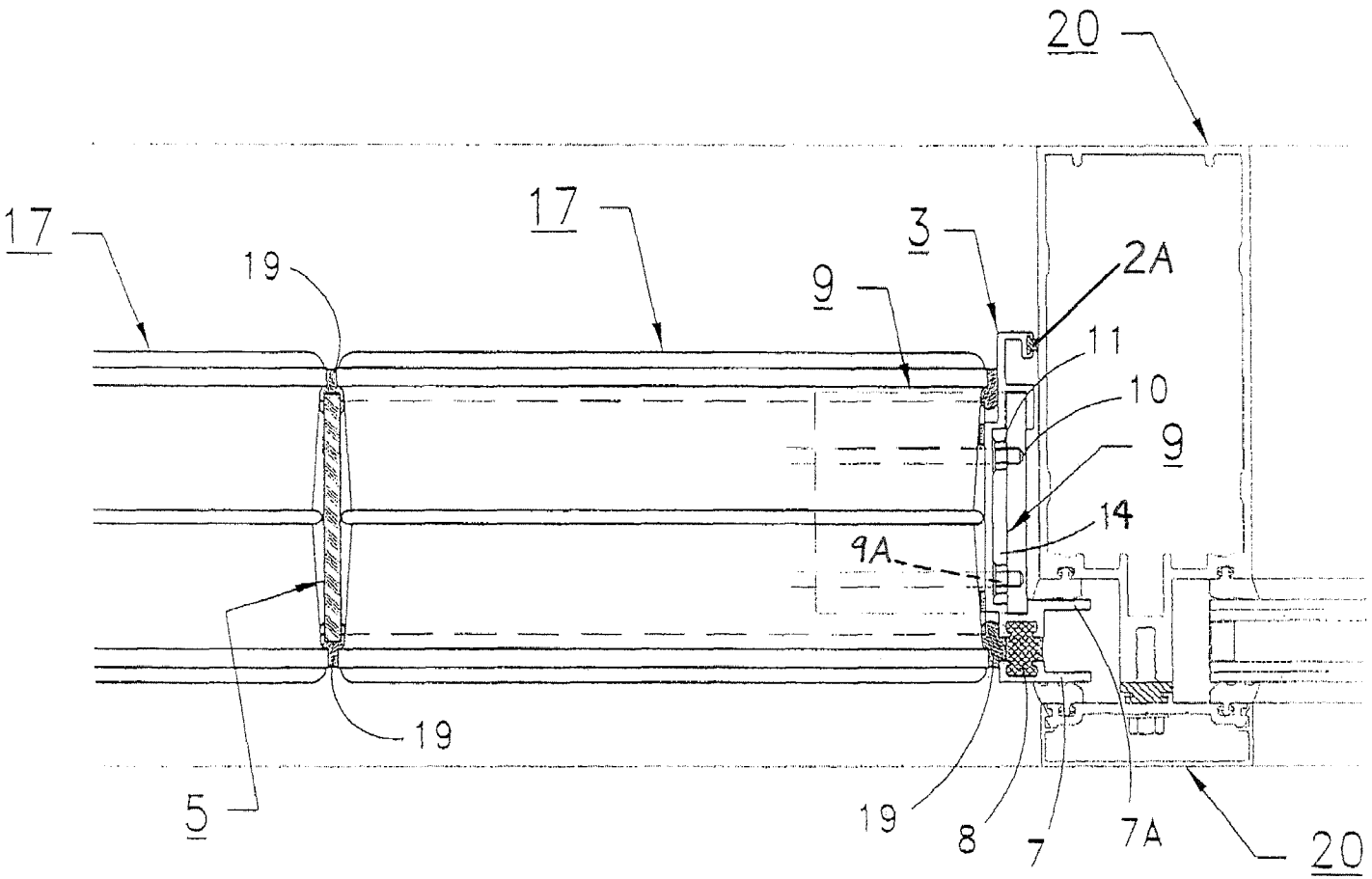
FIG. 4 is a sectional view taken through a jamb member of the assembly shown in FIG. 1.

FIG. 4 shows a section through a jamb member 3, again illustrating the preferred embodiment which contain perimeter flanges 7 and 7A, wherein the flanges 7 and 7A are shown being captured in a conventional curtainwall system 20. The jamb member 3 contains a cavity 14 which is oriented such that rods 10 and nuts 11 can be contained within the cavity without protruding beyond the outside of the jam member 3. Also shown is the engagement of the clip-angle (corner key) 9 within the jamb member 3. As can be seen, holes 9A are defined within each clip-angle 9 (see also FIG. 1 and FIG. 2) and situated to receive the ends of the support rods 10 and contain the ends within the cavity 14 of each iamb member 3. A typical vertical internal framing member 5, which may be composed of, for example, steel, aluminum, plastic or some other suitable material, is shown separating the glass blocks 17 and allowing a very thin (preferably between approximately ⅛ inch and ½ inch) joint which is sealed both inside and out, after assembly, with silicone sealant 19.

FIGS. 3 and 4 further show a perimeter weatherstripping 2A disposed along the opposite edges of the sill member 2, the similar head member (not shown), the first jamb member 3, and the similar second jamb member (not shown). Weatherstripping 2A is situated opposite each pair of flanges 7 and 7A and flanges 6 and 6A to enhance a weatherseal of the assembly when placed within the conventional curtainwall assembly.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A block assembly, comprising:

a plurality of first framing members each having a first longitudinal axis;

a plurality of second framing members each having a second longitudinal axis; said first longitudinal axis being substantially perpendicular to said second longitudinal axis such that said first and second framing members together form a grid including a plurality of openings;

a plurality of blocks, each of said blocks being received within a respective one of said openings;

a plurality of support rods, each of said support rods being inserted through a respective one or more of said first framing members along the first longitudinal axis of each of the one or more of said first framing members and being inserted through each of said second framing members;

a first jamb member provided at a first outer side of said assembly, a second jamb member provided at a second outer side of said assembly opposite said first outer side, a sill member provided at a third outer side of said assembly, and a head member provided at a fourth outer side of said assembly opposite said third outer side, each said jamb member and each said sill member have cavities defined therein;

one or more L-shaped clip angles, each said clip angle configured to hold together said assembly at bottom corners defined by said sill member and each said jamb member; and, holes defined within each said clip angle and situated to receive ends of said support rods and contain said ends within the cavity of each said jamb member.

2. The block assembly according to claim 1, wherein each of said first framing members has at least two of said support rods inserted therethrough.

3. The block assembly according to claim 1, wherein each of said support rods is inserted through a respective two or more of said first framing members.

4. The block assembly according to claim 1, wherein each of said second framing members is provided in between respective first ones of said first framing members and respective second ones of said first framing members.

5. The block assembly according to claim 1, wherein each of said support rods has a first threaded end and a second threaded end, and wherein a first nut is provided on each first threaded end and a second nut is provided on said second threaded end.

6. The block assembly according to claim 5, wherein each said first nut, each said second nut and said support rods bind said first framing members, said second framing members and said blocks together.

7. The block assembly according to claim 1, wherein each of said support rods is inserted through said first jamb member and said second jamb member.

8. The block assembly according to claim 1, wherein each joint between each adjacent ones of said blocks is between about one-eighth of an inch and about one-half of an inch wide.

9. The block assembly according to claim 8, wherein the joint between each adjacent ones of said blocks is sealed with a sealant.

10. The block assembly according to claim 9, wherein said sealant is silicone.

11. The block assembly according to claim 1, wherein said first framing members are oriented in a horizontal manner and said second framing members are oriented in a vertical manner.

* * * * *